United States Patent [19]

Kirkpatrick et al.

[11] 4,234,042

[45] Nov. 18, 1980

[54] DIRECT COMBUSTION STIMULATION OF A PRODUCING WELL

[75] Inventors: John W. Kirkpatrick; Lawrence N. Mower, both of Tulsa, Okla.

[73] Assignee: Standard Oil Company (Indiana), Chicago, Ill.

[21] Appl. No.: 2,496

[22] Filed: Jan. 11, 1979

[51] Int. Cl.[3] ..... E21B 43/243; E21B 43/25

[52] U.S. Cl. ..... 166/261; 166/251

[58] Field of Search ..... 166/302, 278, 51, 258, 166/251, 256, 285, 297, 263

[56] References Cited

U.S. PATENT DOCUMENTS

| | | | |
|---|---|---|---|
| 2,677,428 | 5/1954 | Clark | 166/278 |
| 2,994,375 | 8/1961 | Hurley | 166/258 X |
| 3,159,215 | 12/1964 | Meldau et al. | 166/251 X |
| 3,964,547 | 6/1976 | Hujsak et al. | 166/303 X |
| 4,147,213 | 4/1979 | Hollingsworth | 166/256 |

*Primary Examiner*—Stephen J. Novosad

*Attorney, Agent, or Firm*—James H. Dautremont

[57] ABSTRACT

In the course of completing a production well in a heavy oil or tar sand reservoir arranged for frontal displacement, thermal drive from at least one injection well, the well is divided into separate, non-communicating lower and upper zones. The lower is connected with the reservoir by perforations; the upper by a large gravel packed zone and preferably a sand screen.

The completion process involves starting a local combustion drive adjacent to the bottom of the well by injecting compressed air through the perforations while preventing upward migration of the combustion zone in the vicinity of the well by injection of water or dilute aqueous soap solution through the screen and gravel packed zone. After a suitable time, generally of the order of a month or less, air injection is stopped. Production is started through the screen (no workover or killing operation needed).

After producing some or all of the combustion product gas and locally heated oil, the well is still hot, with a region of high permeability adjacent to the gravel packed zone, ready to produce fluids and/or gas from a distant injection well.

Should further heating be needed later in the life of this well, the annular space normally used for production can be displaced with a soap solution after which the local heating step is repeated.

6 Claims, 1 Drawing Figure

DIRECT COMBUSTION STIMULATION OF A PRODUCING WELL

BACKGROUND OF THE INVENTION

General methods of completion of production wells in heavy oil or tar sand reservoirs, as practiced until a few years ago, are in general not pertinent to more recent work, including the invention disclosed below. The earliest reference which appears of other than general significance is the L. E. Elkins U.S. Pat. No. 3,504,745. This teaches minimizing vertical passage of fluids outside a well by injecting into the path (which would otherwise be followed by such fluids) a foaming agent which can, for example, be an aqueous solution of any of a number of cited soaps, at a concentration in the order of 1 to 2%.

The T. S. Buxton, et al. U.S. Pat. No. 3,399,722 teaches creating separate upper and lower sets of perforations into a reservoir in a tar sand or heavy oil locale. First a zone of high permeability is created by combustion through the perforations at the lower part of the zone. After this has been carried on for several days, the zone is killed and the upper zone created by perforating. Production of heated material from the reservoir occurs through the upper zone. Accordingly, only one of these two zones (upper and lower zones of the reservoir) is used at one time. Our process intentionally uses flow of quite dissimilar fluids for different purposes into each of the two zones (upper and lower) simultaneously, in order to condition the production well for use in our invention.

The Brown Pat. No. 3,329,205, teaches placing a gravel pack liner in the well, and then heating the medium by injecting it through the gravel pack. This, of course, deals with injection wells whereas our invention is concerned with a production well. Also, we do not employ a heating medium injected through a gravel pack.

R. M. Jorda shows a production well assembly for in situ combustion operations in U.S. Pat. No. 3,160,208. A number of perforations extend through the walls of two casing strings into a formation to be produced. Production resulting from in situ combustion enters these conduits and can be pumped from the well. Hot produced gases can flow out of the well through the annulus between a production string and the inner casing string. However, the inventor does not discuss means of conditioning the well prior to its use for ordinary production.

B. G. Harnsberger in U.S. Pat. No. 4,066,127 teaches circulating hot fluids out into the formation through a set of upper perforations into a reservoir and back through a set of lower perforations to form a void in the tar sands. This is followed by gravel packing the void, and injecting further hot fluids through the upper perforations to flow heated organic material from the reservoir through the gravel pack and a sand screen. This involves several disadvantageous procedures compared with ours. We provide for only outflow through the lower perforations, and never create a void in the reservoir by a melting process. This creates too many problems of sand movement through and near the void—and sand control is vital in production of tar sands and heavy oil from the usual unconsolidated reservoirs. There are other differences, but this is sufficient to show that these are quite different processes.

Finally, R. B. Needham in U.S. Pat. No. 4,068,717 provides a method for tar sands reservoir production using the difficult practice of employing steam to fracture from an injection to a production well in the reservoir. These steps do not otherwise condition the production well (which is the object of our invention). He uses the injection of steam, accompanied by a surface-active agent, to produce the reservoir, rather than a frontal thermal drive as employed by us.

It is thus apparent that these literature references, considered alone or together, do not teach the essence of our invention, as summarized below.

SUMMARY OF THE INVENTION

This concerns completion technique and production operations for a producing well in a reservoir of heavy oil or tar sand, which is to be produced by a frontal thermal displacement drive from one or more relatively distant injection wells. Such a well should be completed and operated so that the sand flow from the reservoir into the well is substantially prevented while the region immediately about the well offers maximum permeability to flow of the warmed petroleum. This minimizes bypassing of the well by the heated organic matter in the reservoir—an important factor.

In the completion, a screened gravel-packed zone of large dimensions is arranged in the well adjacent the upper part of the reservoir. A lower zone of the reservoir is connected to the well by perforating into lower part of the casing liner. Subsequently, compressed air is passed down into the lower zone through the perforations to cause moderate local heating, while the reservoir formation adjacent to the gravel packing is kept cool by forcing a cooling fluid or divertent such as a dilute soap solution through the packing into the reservoir above the combustion zone. This prevents upward migration of the local combustion front and damage to the well near upper perforations due to excess heat. Especially, it minimizes slumping of the gravel pack into voids in the upper part of the frequently incompetent reservoir due to excessive local heating. When an effective zone of heated tar or heavy oil has been produced, the local heating is stopped by cutting off the compressed air. The warmed material is then produced through the gravel pack and screen into the annulus of the well. Production is not permitted by backflow through the perforations.

When the producing well is initially being drilled, the production string is cemented above the reservoir. The hole below is then underreamed. A calculated volume of set-retarded cement slurry is spotted on bottom. Then, a liner with a blank bottom section below a sand screen is run to such a depth that the bottom is in the cement slurry raising the level to at least near the lower end of the bottom screen.

After this cement has set, the volume between the screen and the limits of the underreamed hole is filled by gravel packing which extends up into the upper part of the liner. Finally, the top of this is sealed off between casing and liner, for example, with more cement. The bottom blank liner section is perforated into the lower zone of the reservoir.

A packer is run on tubing and set in the liner above the perforations and below the screen to produce two separate fluid passages in the well. These zones are fluid tight from each other. Air can accordingly be forced through the tubing, and liquid divertent through the annulus, screen, gravel pack, and into the upper part of the reservoir, so that a local combustion zone is formed at the bottom, which does not reach near the screen area. After a period to obtain a maximum permeability region surrounding the production well, further local heating is unnecessary until the well plugs with cooling heavy oil or tar. Then the annular space can be displaced by the soap solution, and the local heating process repeated.

ASSOCIATED APPLICATION

A patent application, Ser. No. 880,262, which later issued as U.S. Pat. No. 4,147,213 to Hollingsworth, has been filed and assigned to the same assignee. It deals with an advantageous arrangement for a combustion air injection well suitable for use, for example, with this invention.

Attention is also called to a patent application Ser. No. 002,495, entitled "Indirect Thermal Stimulation of Producing Wells," simultaneously filed with this application in the names of L. N. Mower, J. W. Kirkpatrick, F. H. Hollingsworth, and G. R. Jenkins, assigned to the same assignee owning this application. It deals with another method of stimulating a production well for use in a heavy oil or tar sand field.

BRIEF DESCRIPTION OF THE DRAWING

The accompanying drawing represents, in diagrammatic cross-sectional form, a section through the lower part of a well designed in accordance with our teaching.

DESCRIPTION OF THE PREFERRED EMBODIMENT

Figure 1:
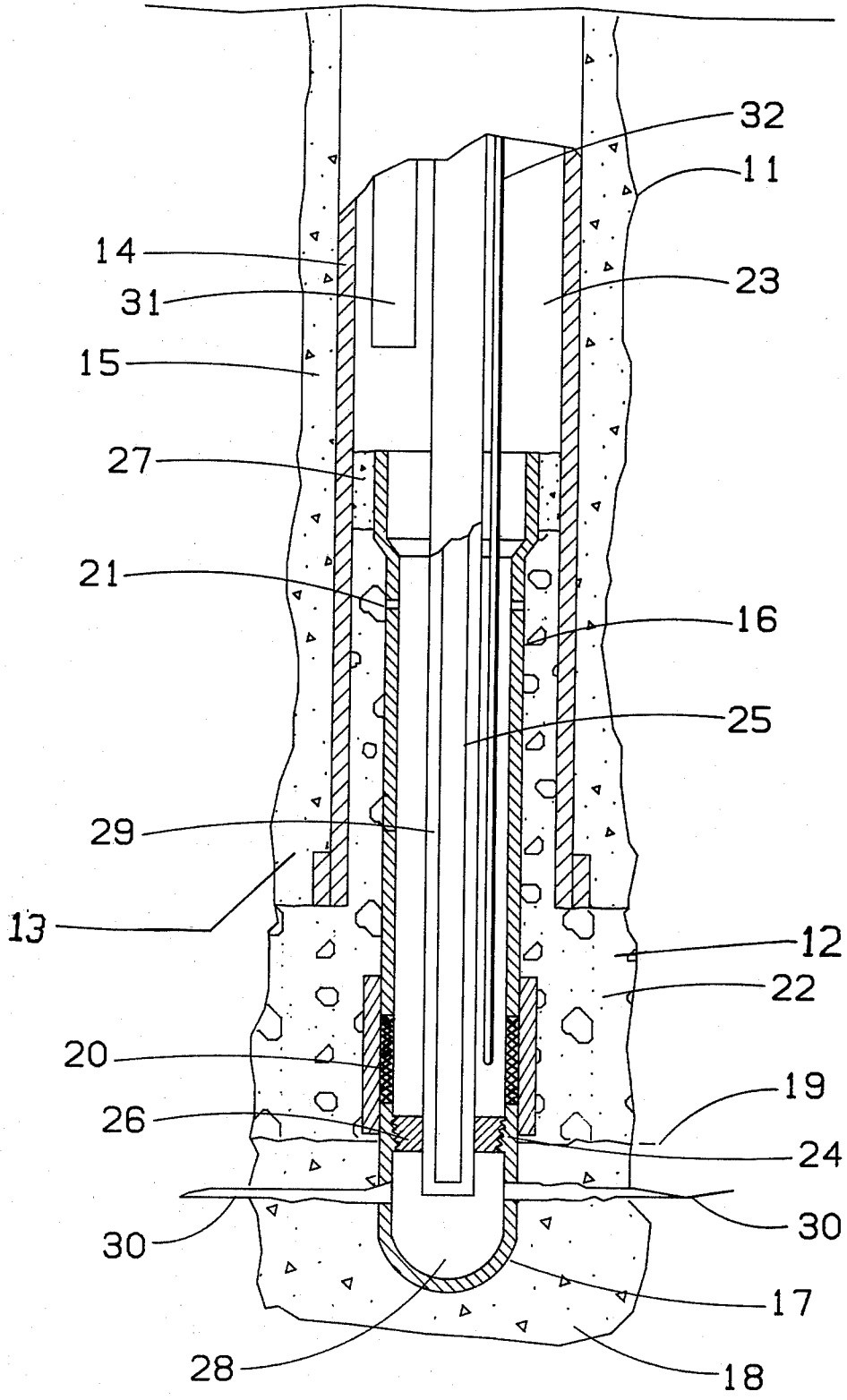

In FIG. 1 a part of well 11 is shown penetrating a heavy oil or tar sand reservoir 12 lying beneath another overlying formation 13. A string of casing 14 has been run in and cemented in the customary fashion by cement 15, the lower end of the casing preferably extending close to but not into the pay zone 12.

The zone in the well below the lower end of casing 14 is then underreamed into the pay zone 12.

As an illustration, in a particular well in the McMurray tar sand deposit in northern Alberta, Canada, a string of $10\frac{3}{4}''$ 51 pound per foot N-80 casing was cemented to a depth of 1052 ft in a production well, and the zone below underreamed to a nominal diameter of 15".

A $5\frac{1}{2}''$ heat-resistant liner 16 was prepared with a blank lower section 17 closed off at the bottom and an intermediate slotted area covered by a keystone wire screen wrapped over slotted pipe. This has been described in U.S. Pat. Nos. 3,366,177 and 3,729,337. Heat resistant cement mixed with water to form a slurry of 15.1 pounds per gallon was spotted on the bottom of the well in zone 18. The volume of 53 sacks was calculated so that when the liner 16 was spotted in the well, the top level 19 of the set-retarded cement slurry would rise until it was just below the bottom edge of the wire wrapped screen 20. (Incidentally, as is usually the case, the sand screen was covered with clinker cement in accordance with the teaching in U.S. Pat. No. 3,729,337.)

Near the top of the liner, a tell tale (ports 21) was located so that in the course of gravel packing it would be possible to gravel pack the upper part of the zone between the liner 16 and the casing 14.

After the set-retarded cement in zone 18 had hardened, zone 22 was gravel packed by running in a crossover tool above the top of the liner, forcing gravel mixed with water into zone 22 so that the gravel filled the region between the outside of the sand screen 20 and the adjacent walls of the pay zone 12, water being separated out through the screen. After the gravel level was above the screen, water separated from the gravel in the tell tale ports 21, which permitted an important feature of this invention: The gravel packing was carried up near the top of the liner. This produces a volume of gravel above the reservoir so that if subsequently there is slumping of the usually incompetent pay zone formation 12 adjacent the gravel pack zone 22, reserve gravel in the upper part of the pack will automatically flow down by gravity and fill the interstices, keeping screen 20 from being exposed directly to the flow of fluids and formation sand into the annular zone 23 of the well.

Above the lower end of the blank section 17 of the liner there had been inserted a packer seat 24. There are a number of designs of such a seat; we prefer to use one with coarse female threads. This enables an air injection string 25 to be later run in the well with a metal packer 26 suitable for mating with the packer seat 24 near the bottom. Before running string 25, at the completion of the gravel packing, the zone 27 between liner and casing 14 above the top of the gravel pack 22 is sealed off from fluid flow. This may take place by using a jam-on packer at this point, which is now seated, but preferably this top area between liner and casing is sealed by pouring in a suitable volume of cement slurry and permitting it to set in place.

The blank wall of the liner is lower zone 28 was perforated (30) using abrasive jet perforating at the interval from 1095 to 1096 ft with four perforations per foot.

Now the air injection string 25 is run into the lower zone 28 of the well, that is, below the packer 26 and the packer made up on the packer seat. Since this air injection string 25 will subsequently become quite warm, we prefer to minimize any buckling by using a tubing head which permits setting this string under tension. In the example of the well, this was a string of $2\frac{7}{8}''$ Hydril tubing set at 961 ft. Within it was run a gas injection string 29 (not always necessary; it simply depends on the ability of the formation easily to be ignited into a combustion phase), made up of NUE tubing landed at 1094 ft.

A string of $2\frac{7}{8}''$ Hydril tubing 31 was landed at 961 ft to serve as the production string. In other words, production of petroleum from this well took place through this string set in the annulus of the well.

To investigate temperature conditions near the bottom of the well a 1" thermocouple string 32 was run from the wellhead to nearly 1079 ft. This permitted important temperature measurements immediately adjacent the sand screen 20.

With this arrangement, a local combustion drive was started by injecting compressed air through string 25 and natural gas through the gas line 29 to ignite the formation. Combustion occurred roughly in a radial pattern beyond the end of perforations 30. In order to cause the heating of the formation around the producing well, as desired, chiefly in the lower part of the pay zone and especially not in the region adjacent the gravel pack zone 22 and the sand screen 20, the divertent liquid was forced at from about 1 to about 20 bbl/day out through the screen 20 and the gravel pack, from the annular space around the string 25.

While water can be used for this purpose, we prefer to use a dilute soap solution, such as, for example, the arrangement taught in the Elkins U.S. Pat. No.

3,504,745. Concentration of the foaming agent in the solution was in the order of 1% by weight. This flow of divertent was maintained as long as compressed air was being injected through string 25, a period of approximately two months. By this time, enough of the tar had been heated to increase substantially the permeability of the zone adjacent the bottom of the well so both compressed air and divertent flow were stopped.

This period can be adjusted, depending on the rapidity with which the zone around the well can be effectively heated. About 10 days appears to be the lower limit; it is doubtful that a period over about 3 months is needed.

The well was then placed on production. This entailed maintaining no flow in strings 25 and 29 (so that heated tar would not backflow through the perforation 30 into zone 28), while permitting flow back through the gravel pack zone 22, the sand screen 20, up the annulus space, and through tubing string 31. At the same time, steps were taken to commence a thermal frontal drive by injection of combustion air at relatively remote wells. It was assumed that in the order of weeks most of the local combustion product gases and the locally heated oil resulting from the local combustion front in the pay zone had been produced. The well was still hot, as evidenced by the reading of the thermocouple in string 32, and was ready to produce gas and fluids from the distant injection wells. Incidentally, the injection well design was that discussed in the associated application mentioned earlier in this specification.

Several months later, after a production of several thousand barrels of hot oil (heated tar) due to the frontal displacement drive employed, it was noted that the pressure drop had considerably increased near this particular production well. This is the indication that another batch of divertent should be mixed up and pumped down tubing 31 to displace hot tar from the annular space in the well. As soon as such divertent flows into pay zone 12, a small slug of water (around 5 to 10 bbls) followed by compressed air can be applied through string 25 into the lower part of the pay zone, and the local combustion front process repeated.

It will be understood by those skilled in this art that there can be a considerable variation in the individual steps from the detailed system described without departing from the spirit of the invention. The invention itself is best described the appended claims.

We claim:

1. A method for direct combustion stimulation of a production well for producing from a heavy oil or tar sand reservoir penetrated by said well, comprising the following steps:

a. placing casing carrying a sand screen into said well with said screen located opposite an upper zone of said reservoir, b. placing a gravel pack in the space between said casing and said upper zone adjacent said well up to an elevation considerably above the top of said screen, and sealing said space above the top of said gravel pack, c. establishing fluid communication between the lower part of said casing and a lower zone in said reservoir below said upper zone, d. dividing the space within said well into two contiguous fluid passages substantially impervious to leakage therebetween, each of said passages communicating with the top of said well, one with said gravel pack and the other with said lower part of said casing, and e. simultaneously forcing an oxygen-containing fluid through one of said passages and into said lower zone of said reservoir, and an aqueous divertent liquid through the other of said passages, through said gravel packing, and into said upper zone of said reservoir, whereby organic material in said lower zone and near said well is warmed and its viscosity substantially reduced without thermal damage to said screen, so that at least some of said organic material may be subsequently removed through said well to increase the flow capacity of said well.

2. A method in accordance with claim 1 including the additional steps of:

f. placing a predetermined volume of cement slurry in the bottom of the well before placing said screen-carrying casing in said well sufficient to anchor said casing but insufficient to clog said screen, g. said casing below said screen being fluid impervious before step c of claim 1, and said casing being placed in said well before the setting of said slurry so as to displace some of said slurry upward.

3. A method in accordance with claim 2, in which:

h. said slurry extends up near but not substantially beyond the bottom of said screen, i. said slurry is permitted to set before carrying out step b, claim 1, and j. said divertent comprises an aqueous dilute soap solution containing in the range of about 1 to about 3% soap.

4. A method in accordance with claim 3 including the step of:

k. underreaming at least most of the part of said well contacting said reservoir, so that the volume of gravel in the gravel pack is at least about double that which could be placed in said part of said well if it had not been underreamed.

5. A method in accordance with claim 4 including the steps of:

l. maintaining flow of fluids as set out in step e of claim 1 for a period of at least 10 days but not exceeding about 3 months, and thereafter m. maintaining the well shut in without flow for a period of the order of 1 to 3 days before substantial removal of organic material.

6. A method in accordance with claim 4 in which said opening of fluid communication with the lower zone in said reservoir is accomplished by perforating, and including:

n. maintaining a frontal displacement thermal drive to produce organic material from said reservoir through said screen into and through said well, and o. subsequently stopping said drive, displacing organic material from its fluid passage in said well by forcing aqueous divertent material down said passage, and repeating step e of claim 1 to repeat stimulation of said well.

* * * * *